US007421745B2

(12) United States Patent
Levy

(10) Patent No.: US 7,421,745 B2
(45) Date of Patent: Sep. 9, 2008

(54) TOILET SUPPORT APPARATUS

(76) Inventor: Aitan Levy, 19120 Sprague St., Tarzana, CA (US) 91356

( * ) Notice: Subject to any disclaimer, the term of this patent is extended or adjusted under 35 U.S.C. 154(b) by 0 days.

(21) Appl. No.: 11/555,235

(22) Filed: Oct. 31, 2006

(65) Prior Publication Data

US 2007/0094778 A1 May 3, 2007

Related U.S. Application Data

(60) Provisional application No. 60/596,935, filed on Oct. 31, 2005.

(51) Int. Cl.
*E03D 11/00* (2006.01)
*E03D 11/14* (2006.01)

(52) U.S. Cl. ..... 4/251.1

(58) Field of Classification Search ..... 4/252.1–252.3, 4/643–645; 248/188.2, 188.4, 188.5
See application file for complete search history.

(56) References Cited

U.S. PATENT DOCUMENTS 2,535,613 A * 12/1950 Vanderbeek ..... 248/188.4
5,380,275 A * 1/1995 Kensey et al. ..... 604/27
2005/0268390 A1* 12/2005 Wright ..... 4/252.1
2006/0277673 A1* 12/2006 Brescia ..... 4/252.1

* cited by examiner

*Primary Examiner*—Huyen Le

(57) ABSTRACT

An apparatus and method for supporting a wall mounted toilet with a toilet bumper in contact with the underside of the wall mounted toilet. The toilet bumper includes an adjustable support leg having an upper end mounted to the toilet bumper and a support foot mounted to a lower end of the adjustable support leg to rest against a floor.

13 Claims, 4 Drawing Sheets

TOILET SUPPORT APPARATUS

CROSS-REFERENCE TO RELATED APPLICATIONS

This application claims the benefit of U.S. Provisional Patent Application No. 60/596,935 filed on Oct. 31, 2005 which is incorporated herein by reference.

TECHNICAL FIELD

The present invention relates generally to an apparatus for supporting a toilet, and more particularly to a support for a wall mounted toilet.

BACKGROUND

Wall mounted toilets provide the advantage of improved cleaning ability, since the floor underneath can be accessed with a mop. Wall mounted toilets have a limitation in that they are typically capable of supporting between 300 to 350 pounds, which is somewhat less than a typical floor mounted toilet. The wall mounted toilet is usually supported by a carrier installed inside the wall to which the toilet is attached. Often, the carriers installed inside the wall are only rated to 300 pounds. That is, the toilets secured to the carriers are engineered to hold a person weighting no more than 300 pounds.

There are a number of people that weigh over 300 and many over 400 pounds. If such a person uses a typical wall mounted toilet, they exceed the weight limit of the wall mounted toilet. Since wall mounted toilets are common in hospitals, hotels, airports, and various other locations, there is a likelihood that a person of a weight that exceeds the weight limit of a wall mounted toilet, may use a wall mounted toilet, causing it to break off from its supporting carrier. Injury, discomfort, and embarrassment may result when this happens. Therefore, what is needed is an effective means for supporting a wall mounted toilet, to prevent these situations, thereby reducing injury, as well as legal liability for the owners of facilities with wall mounted toilets.

SUMMARY OF INVENTION

The present invention provides a support for a wall mounted toilet. An adjustable leg is attached to a bumper. The bumper supports the bowl, and the leg rests on the floor, providing additional vertical support. The present invention increases the weight limit of a wall mounted toilet to approximately 1,000 pounds, thereby safely accommodating obese people.

It is an object of the present invention to provide a toilet support that is compatible with a variety of toilets from various manufacturers.

It is another object of the present invention to provide a toilet support that is quick and easy to install.

It is yet another object of the present invention to provide an aesthetically pleasing toilet support, suitable for use in places such as hotels and restaurants.

It is still another object of the present invention to provide an aesthetically pleasing toilet support that is retractable and allows for full cleaning access to the floor.

According to the present invention, there is disclosed an apparatus for supporting a wall mounted toilet, comprising a toilet bumper in contact with the underside of the wall mounted toilet; an adjustable support leg having an upper end mounted to the toilet bumper; and a support foot mounted a lower end of the adjustable support leg and being adapted to rest against a floor.

Further according to the present invention, the toilet bumper has a three sided curved shape in plane view with a rear wall between two outside corners of the bumper and two side walls between the two outside corners and a front corner. Also the upper surface of the toilet bumper has a concave shape and the toilet bumper includes a sidewall which extends about the three sided curved shape in a perpendicular direction to a bottom surface of the toilet bumper.

Still further according to the present invention, the upper surface of the toilet bumper has a three sided cavity formed therein and extending from the rear wall and inward of the two side walls and towards the front corner. Also the three sided cavity has a bottom surface at a depth extending partially towards a lower surface of the toilet bumper.

Yet further according to the present invention, the toilet bumper has an insert disposed within the three sided cavity. The insert is a four sided insert and has an upper surface with a concave shape that matches the concave shape of upper surface of the toilet bumper and the insert has a lower surface that has a shape that matches the shape of bottom surface of cavity so that the insert can be inserted within cavity so that the toilet bumper is used as a unified structure.

Still further according to the present invention, the distance from where the upper surface of the toilet bumper intersects the rear wall of the toilet bumper is less than the distance from where the upper surface intersects the two side walls at the front corner of the toilet bumper.

Also according to the present invention, the bottom surface of the toilet bumper has a cylindrical bore extending towards the upper surface of the toilet bumper and the cylindrical bore has an outer bottom surface and an inner bottom surface wherein the outer bottom surface extends closer to the upper surface of the toilet bumper than the inner bottom surface. The cylindrical bore further includes a central bore projecting from the inner bottom surface towards the upper surface of the toilet bumper, the central bore having an insert with a threaded bore.

Yet further according to the present invention, the adjustable support leg includes a primary thin walled cylindrical shaped leg section open at opposite ends and having a threaded rod projecting through the primary cylindrical shaped leg section and wherein the threaded rod is mounted to an interior wall of the primary cylindrical shaped leg section. Also the adjustable support leg includes a secondary thin walled cylindrical shaped leg section, wherein the secondary thin walled cylindrical shaped leg section is open at one end and has a base portion closing the opposite end, and wherein the base portion has a threaded bore adapted to threadedly receive the threaded rod projecting through the primary cylindrical shaped leg section so that the secondary thin walled cylindrical shaped leg section is telescopedly receive within the secondary thin walled cylindrical shaped leg section.

Further according to the present invention, the support foot is a circular plate having a cylindrical thin walled connector secured thereto and adapted to be received within the open end of the secondary thin walled cylindrical shaped leg section.

Also according to the present invention, the toilet bumper is constructed of a silicon material.

According to the present invention, there is disclosed a method of supporting a wall mounted toilet, comprising the steps of: providing an apparatus for supporting a wall mounted toilet including a toilet bumper adapted to contact with the underside of the wall mounted toilet, an adjustable support leg having an upper end mounted to the toilet bumper and a support foot mounted a lower end of the adjustable support leg and being adapted to rest against a floor; placing the apparatus under the wall mounted toilet so that the toilet bumper is in contact with the underside of the wall mounted toilet; and adjusting the support leg so that the support foot is resting against a floor.

Still further according to the present invention, the method includes the steps of providing the toilet bumper with an upper surface with a concave shape; and disposing the upper surface with a concave shape against the bottom surface of the wall mounted toilet.

Further according to the present invention, the method includes the steps of providing the toilet bumper with an upper surface having a three sided cavity formed therein and an insert disposed within the three sided cavity wherein the upper surface of the insert has a concave shape that matches the concave shape of upper surface of the toilet bumper and the toilet bumper is used as a unified structure; and placing the apparatus under the wall mounted toilet so that the upper surface of the toilet bumper and the upper surface of the insert are in contact with the underside of the wall mounted toilet.

Yet further according to the present invention, the method includes the steps of providing the toilet bumper with a concave shaped upper surface having a three sided cavity having a bottom surface formed therein; and placing the apparatus under the wall mounted toilet so that the concave upper surface of the toilet bumper and the bottom surface of the insert are in contact with the underside of the wall mounted toilet.

Still further according to the present invention, the method includes the steps of retracting the support leg so that the support foot is not resting against the floor.

Further according to the present invention, the method includes the step of applying a bead of adhesive, such as silicone, between the toilet bumper and the bottom of the toilet bowl.

These and other advantages will be apparent from the following detailed description of preferred embodiments.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
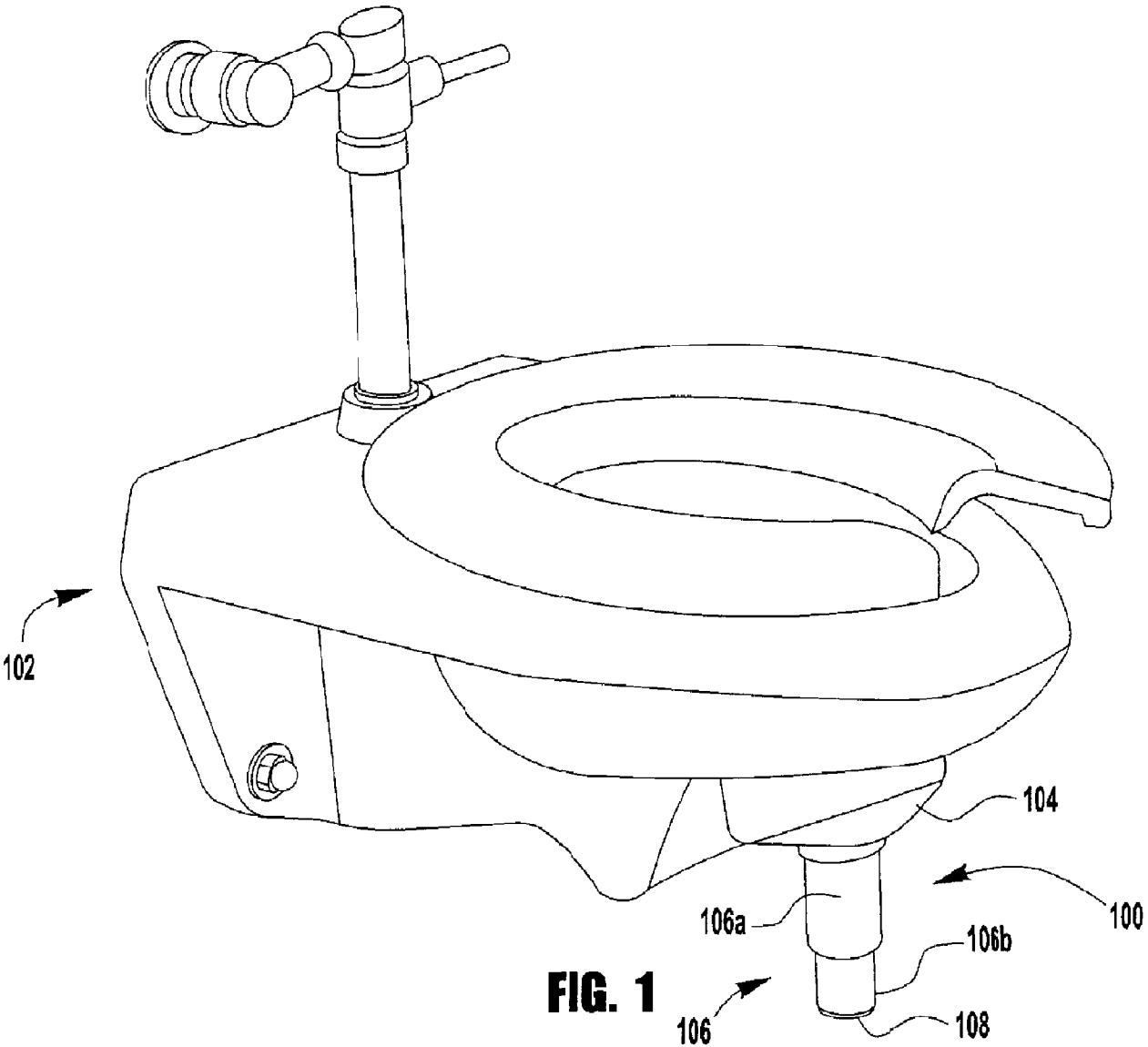

In the drawings accompanying the description that follows, often both reference numerals and legends (labels, text descriptions) may be used to identify elements. If legends are provided, they are intended merely as an aid to the reader, and should not in any way be interpreted as limiting.

FIG. 1 shows a three dimensional view of the present invention being used with a wall mounted toilet.

Figure 2B:
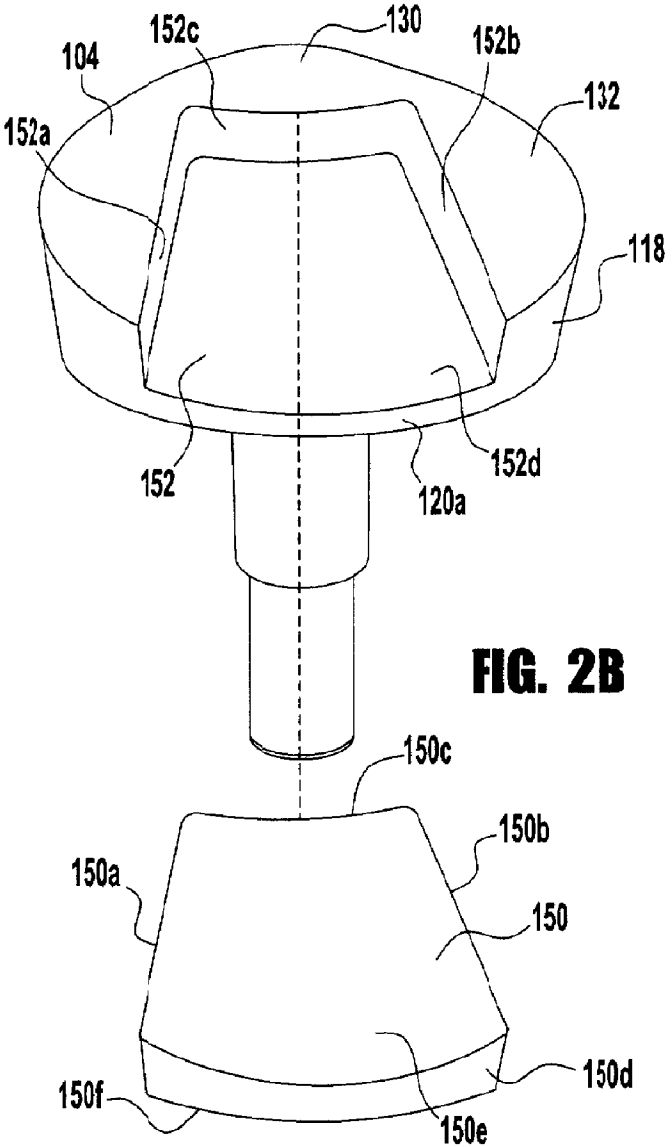
Figure 2A:
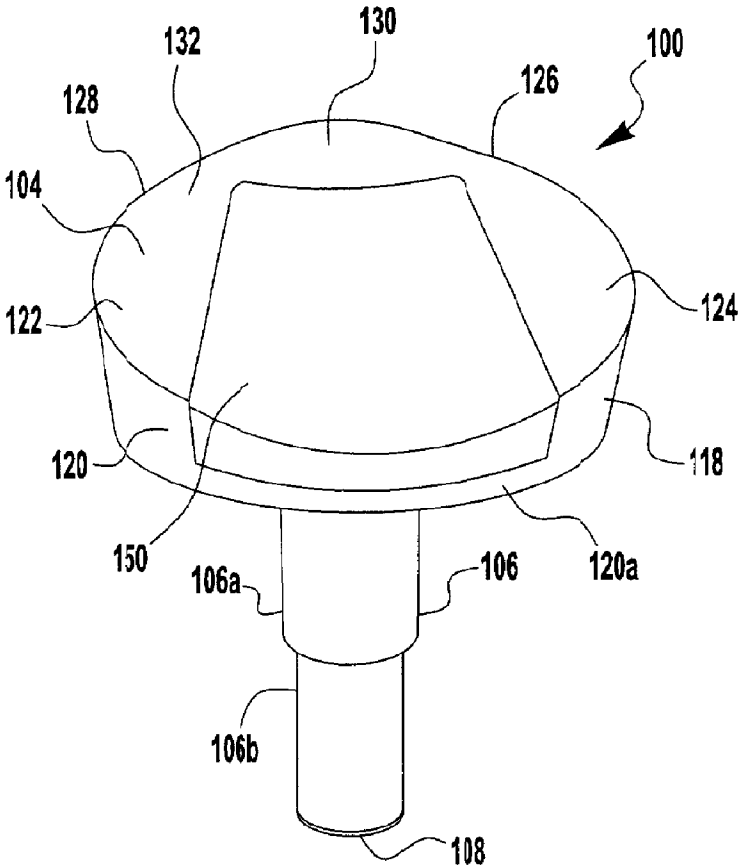

FIG. 2A shows a close-up three dimensional view of the toilet bumper and telescoping leg according to the present invention present invention.

FIG. 2B shows a close-up three dimensional view of the toilet bumper with the insert removed according to the present invention present invention.

Figure 3:
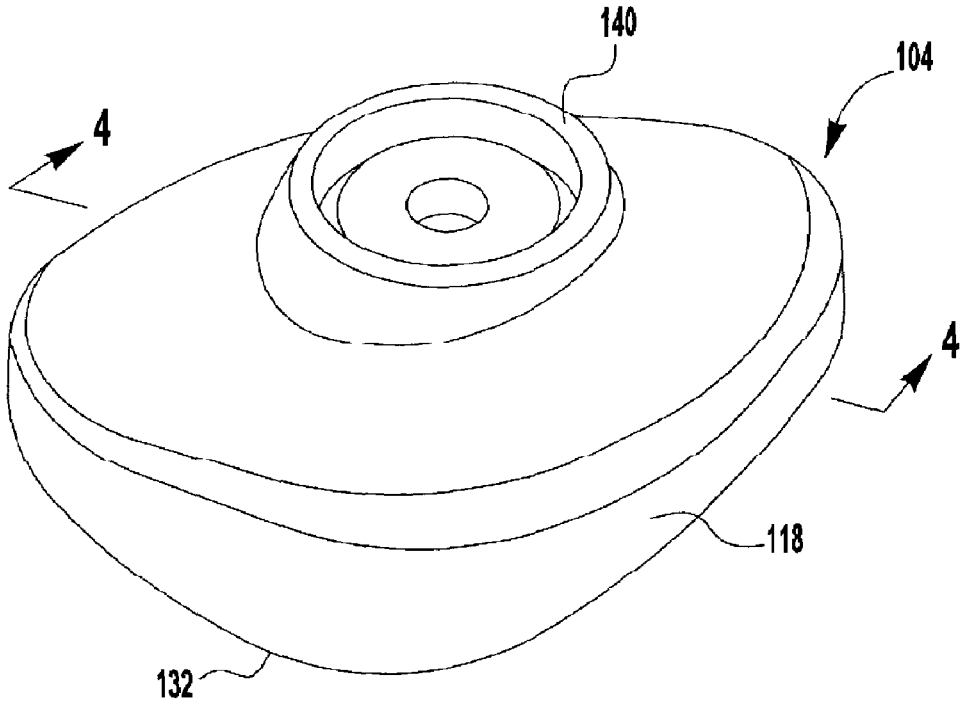

FIG. 3 shows a three dimensional bottom view of the toilet bumper according to the present invention.

Figure 4:
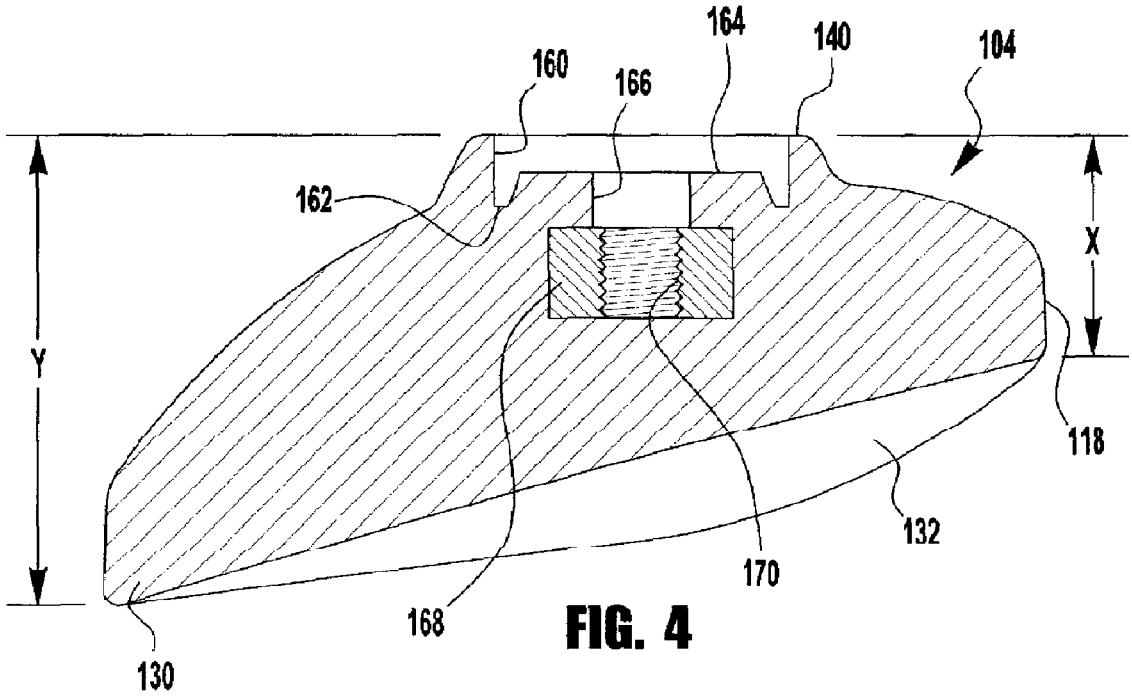

FIG. 4 shows a cross-sectional view through line 4-4 of FIG. 3.

Figure 5:
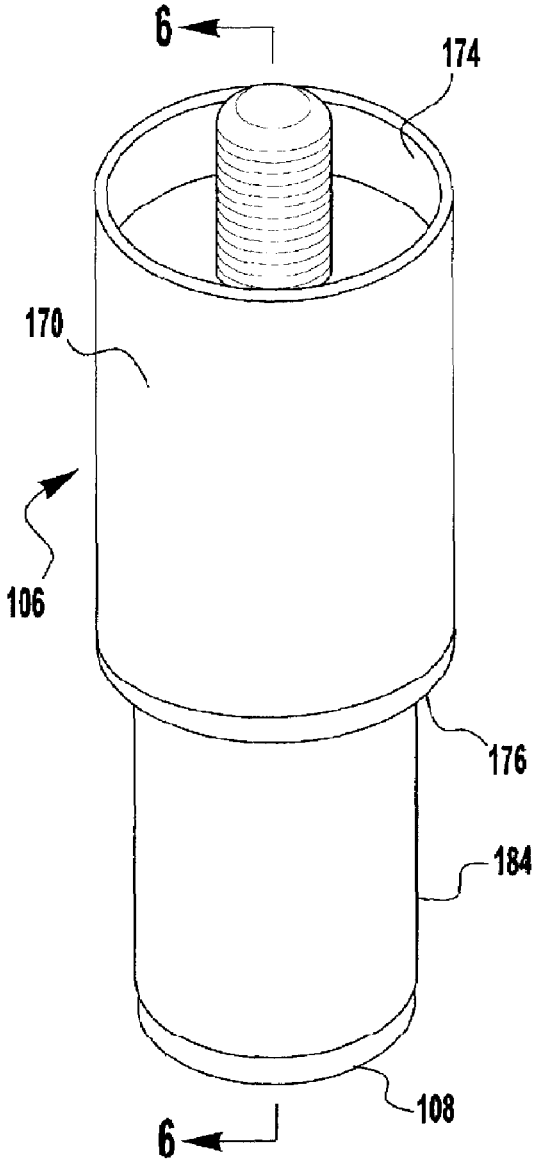

FIG. 5 shows an isometric view of the telescope leg of the present invention.

Figure 6:
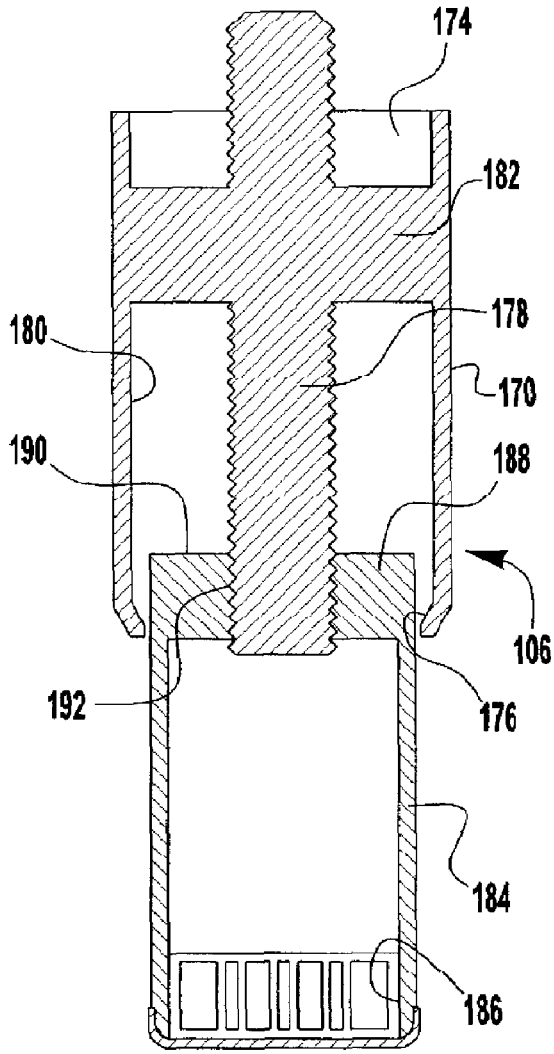

FIG. 6 shows a cross-sectional view through line 6-6 of FIG. 5.

Figure 7:
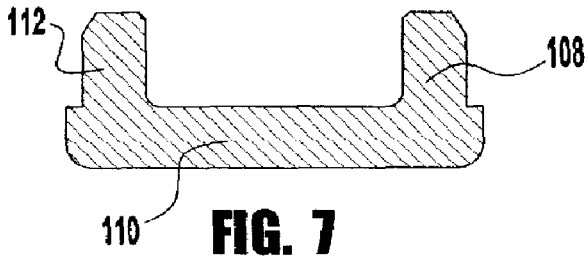

FIG. 7 shows a cross-sectional view of the foot of the present invention.

DETAILED DESCRIPTION OF PREFERRED EMBODIMENTS

FIG. 1 shows the use of the toilet support 100 of the present invention in use with a typical wall mounted toilet 102. The mounted toilet 102 is secured to a carrier installed inside the wall (not shown) to which the toilet is attached with a plurality of bolts. The toilet support 100 includes a toilet bumper 104, a support leg 106 and a support foot 108. Toilet bumper 104 is shown in contact with the underside of the wall mounted toilet 102. The toilet bumper 104 is mounted towards the front end of wall mounted toilet 102 so that the bumper can support the toilet in the event that a heavy person is sitting on the toilet. The adjustable support leg 106 is arranged so that an upper end portion 106*a* is mounted to the toilet bumper 104 and a lower end portion 106*b* is on the floor. Note that a support foot 108 is provided at the lower end 106*b* of the adjustable support leg 106 and is adapted to rest against a floor.

FIG. 2A shows a detailed three dimensional view of the toilet support 100 of the present invention. As mentioned before, toilet support 100 is comprised of three main components, a toilet bumper 104, a support leg 106 and a support foot 108. With regard to the toilet bumper 104, it has a three sided curved shape in plane view with a sidewall 118 including a rear wall 120 between two outside corners 122, 124 of the bumper and two side walls 126, 128 between the two outside corners and a front corner 130. The sidewall 118 extends generally in a perpendicular direction (as shown in FIGS. 3 and 4) to a bottom surface 140 of the toilet bumper 104.

As shown in FIGS. 2 and 3, an upper surface 132 of toilet bumper 104 has a concave shape which is adapted to the shape of the bottom of a conventional wall mounted toilet. The bumper 104 is shaped so that when the bumper is mounted to the bottom of a toilet, the front corner 130 is higher than the rear further away than the outside corners 122,124. This can be seen by referring to FIG. 4, where the distance x from where the upper surface 132 intersects the rear wall 120 of the toilet bumper 104 to the bottom surface 140 is less than the distance y from where the upper surface intersects the two side walls 126, 128 at the front corner 130 of the toilet bumper to the bottom surface 140.

Sometimes, the underside of a toilet is shaped so that the concave shape of the upper surface 132 of bumper 104 does not sufficiently engage the underside of the toilet. To accommodate different shaped toilet bottoms, the toilet bumper 104, as shown in FIGS. 2A and 2B, has a removable insert 150 which fits within a three sided cavity 152 formed in the toilet bumper. As shown in FIG. 213, the cavity 152 has two side walls 152*a*, 152*b*, a forward wall 152*c* and a bottom surface 152*d*. The cavity 152 is formed so that a portion of rear wall 120 of toilet bumper 104 which is between the side walls 152*a* and 152*b* is narrower than the remainder of rear wall 120.

The four sided insert 150, as shown in FIGS. 2A and 2B, has two side walls 150*a* and 150*b*, a front wall 150*c* and a rear wall 150*d*. The upper surface 150*e* of insert 150 has a concave shape that matches the concave shape of upper surface 132 of toilet bumper 104. The lower surface 150*f* of insert 150 has a shape that matches the shape of bottom surface 152*d* of cavity 152. The insert 150 can be inserted within cavity 152 as shown in FIG. 2A so that the toilet bumper 104 is used as a unified structure to support wall hanging toilet 102. Alternatively, insert 150 can be remove from cavity 152 as shown in FIG. 2B. It is also within the terms of the present invention to remove only a portion of insert 150 so that the bumper 104 can accommodate a particular shape of a wall hanging toilet.

Both the toilet bumper 104 and the insert 150 are preferably constructed of a chemical and stain resistant non-porous rubber material such as silicon which can absorb shock created by a heavy individual sitting on toilet 102 and loading the toilet support 100.

Referring to FIGS. 3 and 4, there is shown the bottom of toilet bumper 104. There is shown a bottom surface 140 that would be substantially parallel to a floor on which the toilet support 100 is used. A cylindrical bore 160 extends from bottom surface 140 towards the upper surface 132 of the toilet bumper 104. There is an outer bottom surface 162 of cylindrical bore 160 and an inner bottom surface 154. The outer bottom surface 162 extends closer to the upper surface 132 of the toilet bumper 104 than the inner bottom surface 164. Also, a central bore 166 projects inward from the inner bottom surface 164 towards the upper surface 132 of the toilet bumper 104. The central bore 166 opens to an insert 168 with a threaded bore 170.

Referring to FIGS. 5 and 6, there is shown the adjustable support leg 106. Support leg 106 includes a primary thin walled cylindrical shaped leg section 172 open at opposite ends 174 and 176. A threaded rod 178 projects through the primary cylindrical shaped leg section 172 and is mounted to an interior wall 180 of the primary cylindrical shaped leg section by any means, such as an integral cylindrical sleeve 182. One end of rod 178 projects from end 174 and the other end of rod 178 projects from end 176 primary thin walled cylindrical shaped leg section 172.

The adjustable support leg 106 includes a secondary thin walled cylindrical shaped leg section 184. The secondary thin walled cylindrical shaped leg section 184 is open at one end 186 and has a base portion 188 closing the opposite end 190. The base portion 188 has a threaded bore 192 extending there through and adapted to threadedly receive the threaded rod 178 projecting through the primary cylindrical shaped leg section 172 so that the secondary thin walled cylindrical shaped leg section 184 is telescopedly receive within the primary thin walled cylindrical shaped leg section. By rotating either the primary leg section 170 or the secondary leg section 184, the height (length) of support leg 106 is adjusted.

The end of threaded rod 178 that projects from end 174 of the primary cylindrical shaped leg section 172 is received within the threaded bore 170 of insert 168. As the primary leg section 170 is rotated, the threaded rod 178 moves through threaded insert 168, thereby securing the leg 106 to the toilet bumper 104. Preferably, the primary leg section 170 is rotated until the end cylindrical wall 174 is received in the outer bottom surface 162 of cylindrical bore 160 and the inner bottom surface 164 can be against the integral cylindrical sleeve 182 so that the leg 106 is securely attached to the toilet bumper 104.

In operation, the toilet support 100 may be affixed to toilet 102 by applying adhesive, silicone adhesive or caulking to bumper 104 (note that the bumper can be formed of a silicon material.) Leg 106 is affixed to bumper 104 by the threaded screw 178 engaging screw insert 168 as described herein before. The lower leg member 106*a* is then rotated until foot 110 makes contact with the floor surface. The lower leg 106*a* can be rotated in an opposite direction to raise it when cleaning the floor. This provides the cleaning advantages of a wall mounted toilet, with the weight capacity properties of a floor mounted toilet.

It should be noted that no bolts or fittings need to be adjusted on the wall mounted toilet 102 when installing toilet support 100. The bumper 104 can be molded in a color to match the toilet 102, providing a discrete toilet support that blends in with the toilet itself.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An apparatus for supporting a wall mounted toilet, comprising:

a toilet bumper adapted to be in contact with the underside of the wall mounted toilet;

an adjustable support leg having an upper end mounted to the toilet bumper;

a support foot mounted to a lower end of the toilet bumper adapted to rest against a floor, wherein the toilet bumper has a three sided curved shape with two outside corners and a front corner and a sidewall which extends about the three sided curved shape, the upper surface of the toilet bumper has a three sided cavity with a concave shape formed therein and wherein the three sided cavity has a bottom surface at a depth extending partially towards a lower surface of the toilet bumper, the toilet bumper has an insert disposed within the three sided cavity; and wherein the insert is a four sided insert and has an upper surface with a concave shape that matches the concave shape of upper surface of the toilet bumper; and the insert has a lower surface that has a shape that matches the shape of bottom surface of cavity so that the insert can be inserted within cavity so that the toilet bumper is used as a unified structure.

2. The apparatus of claim 1 wherein the upper surface of the toilet bumper has a concave shape and the sidewall which extends about the three sided curved shape is in a perpendicular direction to a bottom surface of the toilet bumper.

3. The apparatus of claim 1 wherein the distance from where the upper surface intersects the rear wall of the toilet bumper is less than the distance from where the upper surface intersects the two side walls at the front corner of the toilet bumper.

4. The apparatus of claim 1 wherein the bottom surface of the toilet bumper has a cylindrical bore extending towards the upper surface of the toilet bumper; and the cylindrical bore has an outer bottom surface and an inner bottom surface wherein the outer bottom surface extends closer to the upper surface of the toilet bumper than the inner bottom surface.

5. The apparatus of claim 4 further including a central bore projecting from the inner bottom surface towards the upper surface of the toilet bumper, the central bore having an insert with a threaded bore.

6. The apparatus of claim 1 wherein the adjustable support leg includes a primary thin walled cylindrical shaped leg section open at opposite ends and having a threaded rod projecting through the primary cylindrical shaped leg section and wherein the threaded rod is mounted to an interior wall of the primary cylindrical shaped leg section.

7. The apparatus of claim 6 wherein the adjustable support leg includes a secondary thin walled cylindrical shaped leg section, wherein the secondary thin walled cylindrical shaped leg section is open at one end and has a base portion closing the opposite end, and wherein the base portion has a threaded bore adapted to threadedly receive the threaded rod projecting through the primary cylindrical shaped leg section so that the secondary thin walled cylindrical shaped leg section is telescopedly receive within the first thin walled cylindrical shaped leg section.

8. The apparatus of claim 1 wherein the toilet bumper is constructed of a silicon material.

9. A method of supporting a wall mounted toilet, comprising the steps of:

providing an apparatus for supporting a wall mounted toilet including a toilet bumper adapted to contact with the underside of the wall mounted toilet, an adjustable support leg having an upper end mounted to the toilet bumper and a support foot mounted a lower end of the adjustable support leg and being adapted to rest against a floor;

placing the apparatus under the wall mounted toilet so that the toilet bumper is in contact with the underside of the wall mounted toilet;

adjusting the support leg so that the support foot is resting against a floor;

providing the toilet bumper with an upper surface having a three sided cavity with a concave shape;

disposing the upper surface with a concave shape against the bottom surface of the wall mounted toilet;

providing the toilet bumper with the upper surface having a three sided cavity formed therein with an insert disposed within the three sided cavity wherein an upper surface of the insert has a concave shape that matches the concave shape of upper surface of the toilet bumper and the toilet bumper is used as a unified structure; and placing the apparatus under the wall mounted toilet so that the upper surface of the toilet bumper and the upper surface of the insert are in contact with the underside of the wall mounted toilet.

10. The method of claim 9 including the steps of providing the toilet bumper with a concave shaped upper surface with a three sided cavity having a bottom surface formed therein; and placing the apparatus under the wall mounted toilet so that the bottom surface formed within the three sided cavity and the bottom surface of the insert are in contact.

11. The method of claim 9 including the step of retracting the support leg so that the support foot is not resting against the floor.

12. The method of claim 9 including the step of applying a bead of adhesive between the toilet bumper and the bottom of the toilet bowl.

13. The method of claim 12 including the step of applying a bead of silicone adhesive between the toilet bumper and the bottom of the toilet bowl.

* * * * *